US006012264A

United States Patent [19]

Linkiewicz

[11] Patent Number: 6,012,264

[45] Date of Patent: Jan. 11, 2000

[54] ZIPPER SEALER MACHINE

[75] Inventor: John M. Linkiewicz, Prospect Heights, Ill.

[73] Assignee: Triangle Package Machinery Company, Chicago, Ill.

[21] Appl. No.: 09/056,583

[22] Filed: Apr. 7, 1998

[51] Int. Cl.[7] ..... B65B 57/00; B65B 9/00; B65B 9/06

[52] U.S. Cl. ..... 53/75; 53/451; 53/189.2; 53/551; 53/552; 493/208; 493/196; 493/214; 493/388

[58] Field of Search ..... 493/213, 214, 493/208, 197–193, 207, 345, 346, 927, 212, 388; 53/451, 139.2, 138.1, 75, 551, 552, 554, 555

[56] References Cited

U.S. PATENT DOCUMENTS

| | | | |
|---|---|---|---|
| 4,355,494 | 10/1982 | Tilman | 53/416 |
| 4,430,070 | 2/1984 | Ausnit | 493/215 |
| 4,546,596 | 10/1985 | Cherney | 53/75 |
| 4,617,683 | 10/1986 | Christoff | 383/63 |
| 4,625,496 | 12/1986 | Ausnit | 53/451 |
| 4,655,862 | 4/1987 | Christoff et al. | 156/66 |
| 4,844,759 | 7/1989 | Boeckmann | 156/66 |
| 4,846,585 | 7/1989 | Boeckmann et al. | 383/5 |
| 4,876,842 | 10/1989 | Ausnit | 53/410 |
| 4,894,975 | 1/1990 | Austnit | 53/551 |
| 4,909,017 | 3/1990 | McMahon et al. | 53/410 |
| 4,925,316 | 5/1990 | Van Erden et al. | 383/61 |
| 4,971,454 | 11/1990 | Branson et al. | 383/61 |
| 5,024,537 | 6/1991 | Tilman | 383/63 |
| 5,036,643 | 8/1991 | Bodolay | 53/128.1 |
| 5,111,643 | 5/1992 | Hobock | 53/551 |
| 5,127,208 | 7/1992 | Custer et al. | 493/927 |
| 5,400,568 | 3/1995 | Kanemitsu et al. | 53/412 |
| 5,461,845 | 10/1995 | Yeager | 53/451 |
| 5,519,982 | 5/1996 | Herber et al. | 53/412 |
| 5,557,907 | 9/1996 | Malin et al. | 53/139.2 |
| 5,660,479 | 8/1997 | May et al. | 383/204 |
| 5,672,009 | 9/1997 | Malin | 383/204 |

FOREIGN PATENT DOCUMENTS

| | | |
|---|---|---|
| PCT/US98/13834 | 1/1999 | WIPO . |

*Primary Examiner*—Peter Vo
*Assistant Examiner*—Matthew Luby
*Attorney, Agent, or Firm*—Brinks Hofer Gilson & Lione

[57] ABSTRACT

A zipper sealer machine for use with form, fill and seal machines and the method for bonding strips of reclosable fastener material strip fastener material to the film of a form fill and seal machine. The zipper sealer machine is adapted to be mounted within in the form, fill and seal machine and coordinate with the components of the form, fill and seal machine such as its film control mechanism. The zipper sealer machine includes a substantially symmetrically formed rotor having a pair of outer edges. Reclosable fastener material strip fastener material is fed to an outer edge of the rotor and cut to length. The cutting process also fuses the cut ends of the reclosable fastener material strip fastener material . The rotor is rotated 180 degrees, which locates the strip of reclosable fastener material strip fastener material adjacent to the film course at which it is bonded to the film. The reclosable fastener material strip fastener material cutting and fusing device does not utilize a cutting knife and thus requires less service. The zipper sealer machine includes an adjustable film control roll that allows fine tuning of the operation to assure that the reclosable fastener material strip is bonded in the proper relationship to the printout on the film.

12 Claims, 12 Drawing Sheets

ZIPPER SEALER MACHINE

BACKGROUND OF THE INVENTION

The present invention relates to a method and apparatus for applying reclosable fastener material strip to the continuous web of film on a form, fill and seal machine. There are two manufacturing methods for forming reclosable packages on form, fill and seal machines. In one method the reclosable fastener material strip extends parallel to the feed direction of the continuous web of film. In the second method the reclosable fastener material strip extends transverse to the feed direction of the continuous web of film. The present invention relates to the method in which the reclosable fastener material strip extends transverse to the feed direction of the continuous web of film. It is important in forming reclosable packages using this method that the timing of the cross sealing jaws be coordinated with the position at which the reclosable fastener material strip was bonded to the continuous web of film. U.S. Pat. No. 4,655,862 discloses a mechanism for cutting, locating and securing a flexible plastic reclosable fastener material strip across the longitudinal axis of the continuous web of film that is being used to create a package having a reclosable top.

U.S. Pat. No. 4,909,017 discloses a machine for making bags that have a reclosable fastener material on a form, fill and seal machine. The bag forming process disclosed in this patent includes the step of securing reclosable fastener material strip to the film such that it extends transverse to the direction of film feed. In both U.S. Pat. Nos. 4,655,862 and 4,909,017 a continuous web of film is fed to the form, fill and seal machine from a film roll. Prior to reaching the form, fill and seal machine, a reclosable fastener material strip is attached to the surface of the continuous web of film. The reclosable fastener material strips are cut from a continuous ribbon of zip-lock fastener material that is provided from a supply roll. The strip is guided to the lateral edge of the continuous web of film and then into a channel member that overlays the film. The use of a conventional cutting element as suggested in these patents has the disadvantages that the knife blades dull quickly when used on machines that produce upward of a hundred packages per minute and they also get contaminated with melted plastic as a result of heat generated by the rapid cutting action. The use of conventional cutting knifes produces a service problem for machines of this type. A section of reclosable fastener material is cut from the continuous ribbon which is then positioned by the channel on the upper surface of the continuous web of film. The lower surface of the reclosable fastener material strip is secured to the upper surface of the continuous web of film. These patents disclose systems that requires a separate apparatus outside of the form, fill and seal machine for securing the reclosable fastener material strip to the film. As a result there is a long span of film extending from the location outside the form, fill and seal machine where the reclosable fastener material strip was bonded to the film to the point where the continuous web of film encounters the forming shoulder.

The continuous web of film from which packages are manufactured is very thin and is difficult to control. For this reason it is desirable to mount the separate device for bonding the reclosable fastener material strip to the continuous web of film close to the form, fill and seal machine that they serve. In fact, they are mounted so close that they may interfere with the normal servicing of the form, fill and seal machine. The long span of continuous film utilized by these machines must be processed and coordinated to assure that the reclosable fastener material strip is properly located with respect to where the cross seal of the bag is formed and to assure that it is not damaged as it is moved from the point where it is secured to the continuous web of film to the point where it encounters the forming shoulder.

In addition these prior art machines must complete the feeding, severing to length and bonding the segment of reclosable fastener material strip to the film before this sequence for the next segment can begin. Thus, the speed of the form, fill and seal machine that has been retrofitted with the prior art machines disclosed in these prior art patents is very limited. Also, in the prior art machines the two halves of the reclosable fastener material strip are not positively interconnected and thus could separate from each other or shift relative to each other during the subsequent package forming procedure.

SUMMARY OF THE INVENTION

In order to locate the device for securing the reclosable fastener material strip to the film within the confines of the form, fill and seal machine it is necessary that the operation of preparing the severed strip of reclosable fastener material strip be performed close to the film. This is a location where it is very difficult to find space for the reclosable fastener material cutter-fusser mechanism. Applicant has provided a device in which all the operations to prepare the reclosable fastener material strip are performed at a less congested location and then the reclosable fastener material strip is quickly moved into the position where it will be secured to the film by a simple 180 degree rotation of the rotor. Applicant has thus eliminated any interference problem which may exist with the zipper cutter-fusser by rotating the severed strip of reclosable fastener material material .

Applicant's mechanism for feeding, severing and fusing the fastener material strip strip, locating the fastener material strip relative to the film and sealing the fastener material strip to the surface of the film is located within the confines of the form, fill and seal machine. Thus, a separate bulky attachment that interferes with the normal operation and servicing of the form, film and seal machine has been eliminated. Furthermore, in applicant's mechanism while one fastener material strip is being secured to the film the next fastener material strip is, simultaneously, being cut to length and located relative to the film. Thus, applicant's mechanism has the capacity to feed, cut to length and seal the ends of a fastener material strip, locate the severed fastener material strip relative to the film and seal the severed fastener material strip at a predetermined location on the film in a much shorter time period than the prior art devices.

Still another advantage of applicant's device is that the severing and fusing of the reclosable fastener material strip is done by a heated element that has a smooth edge, rather than with a cutting knife or blade. Applicant's device is much cleaner and does not require the maintenance that a knife type cutter requires. Also applicant's device does not become dull and does not require new sharp blades to be added.

Another advantage of applicant's device is the ability to precisely adjust the film positioning roll to assure that the reclosable fastener material strip is properly orientated relative to the printout carries by the film.

DETAILED DESCRIPTION OF THE INVENTION

Figure 1:
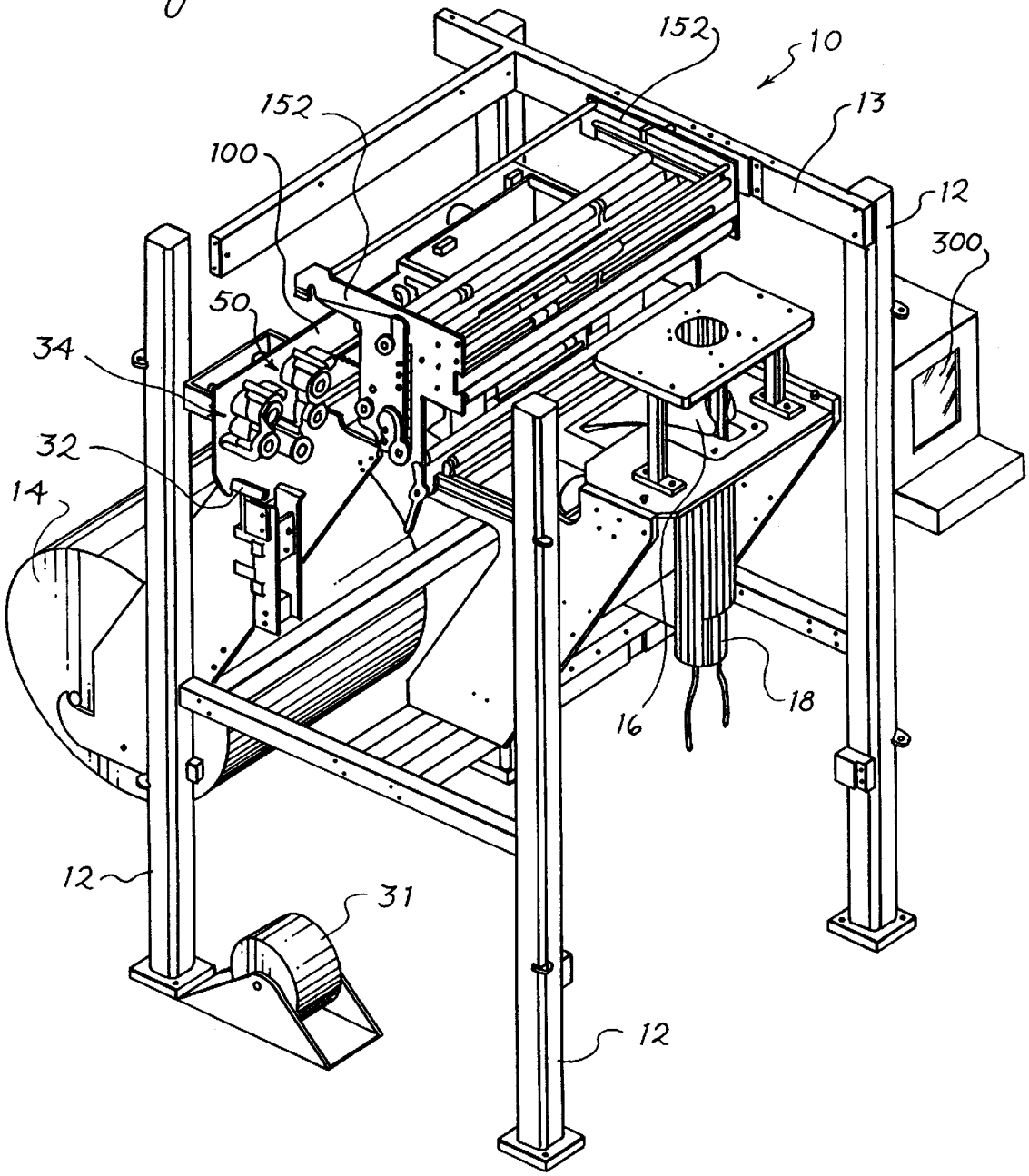
FIG. 1 is a perspective view of a form, fill and seal machine having the zipper sealer device of this invention mounted thereon.

This invention could be used with any commercially available form, fill and seal machine, such as the machine disclosed in U.S. Pat. No. 5,715,656, that issued on Feb. 10, 1998. U.S. Pat. No. 5,715,656 is hereby, by reference made of part of this disclosure. There is shown in FIG. 1 a form fill and seal machine 10 of the type disclosed in U.S. Pat. No. 5,715,656. In FIG. 1 portions of the conventional form, fill and seal machine 10 have not been shown in order to better illustrate the invention of this application. The form, fill and seal machine has a frame including four posts 12 and horizontal members 13. The film for forming packages on machine 10 is carried by a film roll 14. The film that is dispensed from the film roll 14, as is fully disclosed in U.S. Pat. No. 5,715,656, follows a circuitous route over a film guide mechanism that includes a series of rollers. After winding through the film guide mechanism the film is fed to the forming shoulder 16 which causes the film to be wrapped around the forming tube 18. The forming tube 18 shapes the film into a continuous longitudinal tube that is sealed by a longitudinally extending device. A central processing unit 300 for the form, fill and seal machine is shown in FIG. 1.

The form, fill and seal machine includes cross sealing jaws (not shown) that produce a cross seal that will be the bottom seal for the next package to be produced and a top seal for the package just completed. Between this bottom and top seal there is a knife that separates the package just completed from the next package to be produced. The cross sealing jaws also produce a line of perforations that extend across the top of the package below the top seal. Below this line of perforations the cross sealing jaws seal the remaining two flanges reclosable fastener material strip to the inside surface of the package. The consumer can then remove the top seal along the line of perforations and then use the reclosable fastener material strip to reclose the package. The cross sealing jaws used in this invention are not conventional but form no part of this invention.

Figure 5:
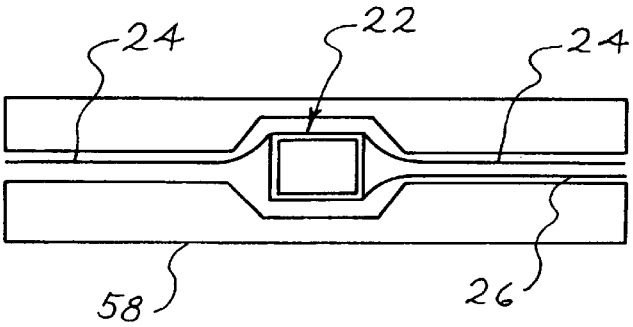
FIG. 5 is a cross section view of the horizontally oriented track taken along lines 5—5 of FIG. 4.

The interlocked reclosable fastener material 22 is supplied as a continuous strip or ribbon from a roll 31 shown in FIG. 1. The reclosable fastener material preferably consists of two halves that are interlocked before being placed on the roll 31. As best seen in FIG. 5, the upper half of the interlocked reclosable fastener material strip has an mounting flange 24 extending from both sides and the bottom half has an a single mounting flange 26 extending from one side.

Figure 2:
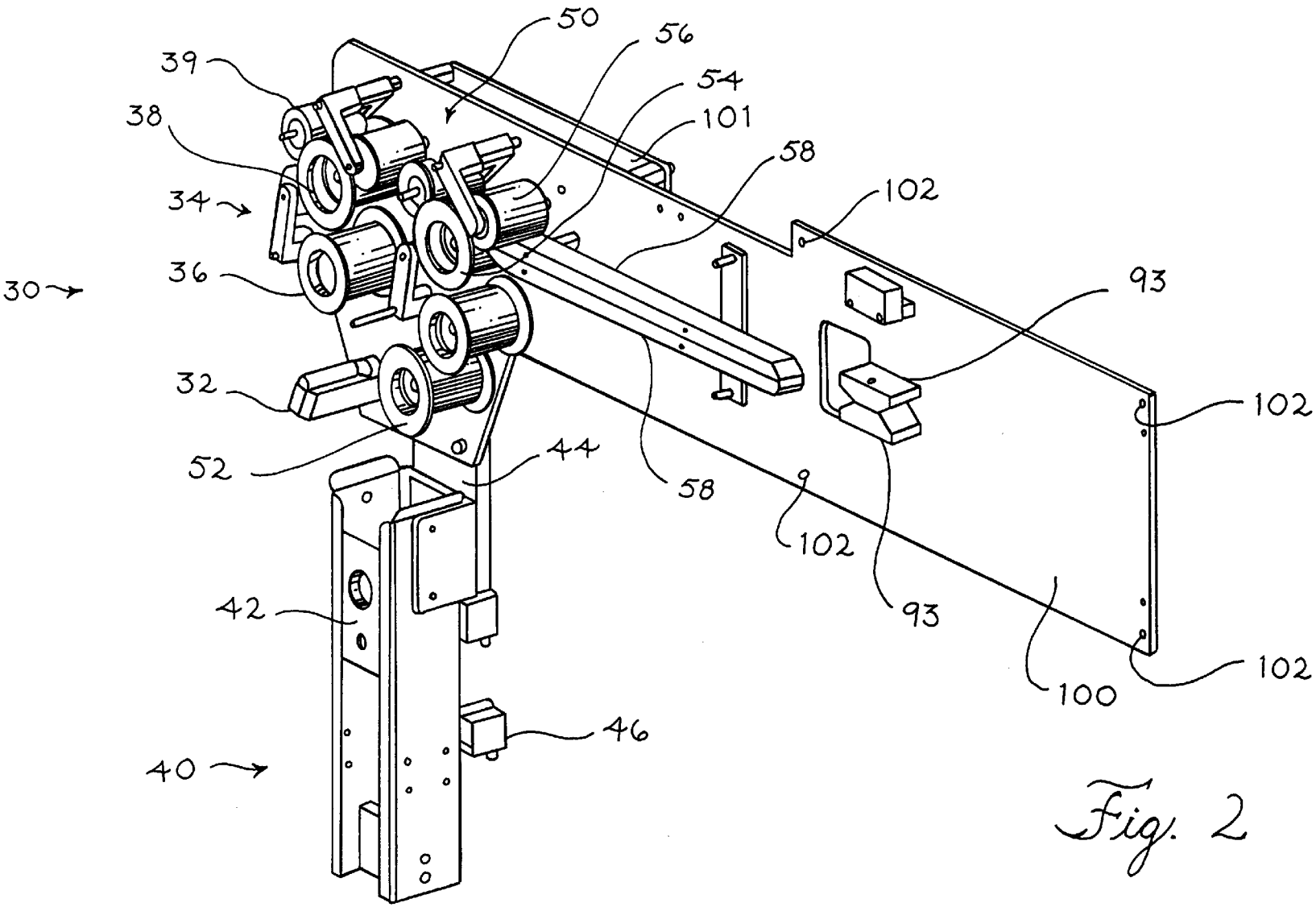
FIG. 2 is a perspective view of reclosable fastener material mechanism feeder assembly.

The reclosable fastener material travels from the roll 31 to a reclosable fastener material feeding mechanism generally designated 30, as shown in FIG. 2. The components of the reclosable fastener material feeding mechanism are mounted on a mounting plate 100. The zip-lock material 22 enters the feeding mechanism 30 through an eyelet 32, from which it extends upward to the primary feeder 34. From eyelet 32 reclosable fastener material 22 extends around spool 36 and over the top of the driven roll 38 in the primary feeder 34. The driven rolls 38 and 54 are driven by stepper motors 35 carried on stepper motors 35, see FIG. 8, mounting plate 101 that is secured to the back surface of mounting plate 100. Spring-biased pressured rollers 39 bias the reclosable fastener material into engagement with drive roll 38.

The reclosable fastener material 22 extends from the primary feeder 34 down into the dancer 40 where it wraps around a roll carried by a slide member 42. The dancer 40 is a vertically extending trough like device that is supported on the mounting plate 100 through a dancer support plate 44. The slide member 42 and the roll carried thereby is free to reciprocate in the trough-like structure the dancer 40. The slide member 42 function to retain the dancer roller in proper orientation in the trough-like structure. When the sliding dancer roller moves down, as a result of reclosable fastener material being fed to it by the primary feeder 34, a reserve of reclosable fastener material 22 is stored in the dancer 40 which enables the secondary feeder 50 to quickly draw the reserve of reclosable fastener material from the dancer 40.

A proximity-type electric eye 46 is carried by the dancer 40 which recognizes the dancer roller when it reaches the bottom of the dancer 40. When the presence of the dancer roller is recognized by electric eye 46, power to the stepper motor that drives the primary feeder 34 is turned off. When the secondary feeder 50 draws off the reserve of reclosable fastener material stored in the dancer 40, the dancer roller moves up and contact with electric eye 46 is broken. When this contact is broken a signal is sent to the stepper motor driving the primary feeder 34 which causes more reclosable fastener material to be drawn from the supply roll 31 and fed to the dancer 40.

The secondary feeder 50 includes two guide roll 52 and a driven roll 54. Spring biased pressure rollers 56 bias the reclosable fastener material into engagement with drive roll 54. The reclosable fastener material 22 is measured and fed by the secondary feeder 50 into a horizontally oriented track 58. The track 58 feeds the reclosable fastener material 22 to a reclosable fastener cutter-fuser mechanism generally designated 60, in FIGS. 3 and 4.

Figure 7:
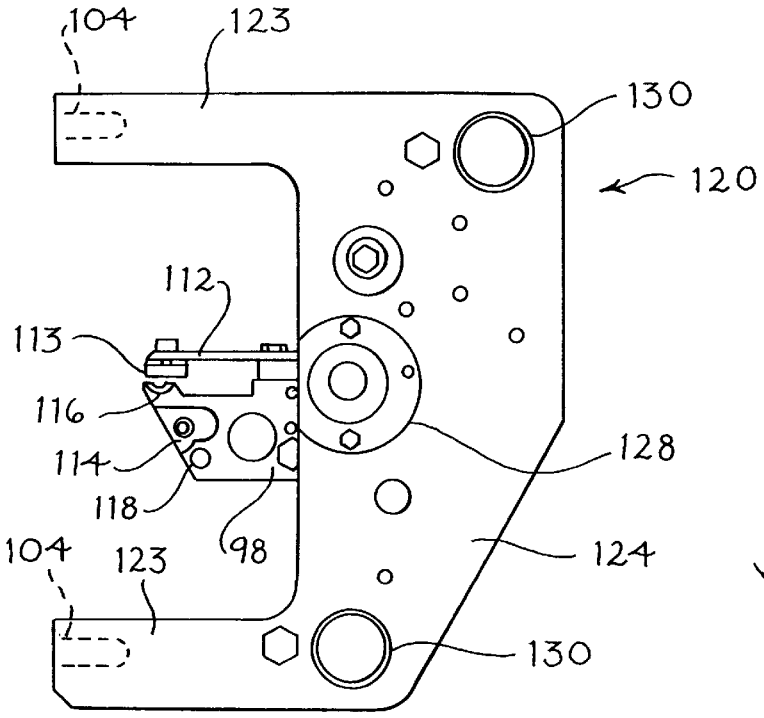
FIG. 7 is an end view of the rotor carriage mechanism.
Figure 11:
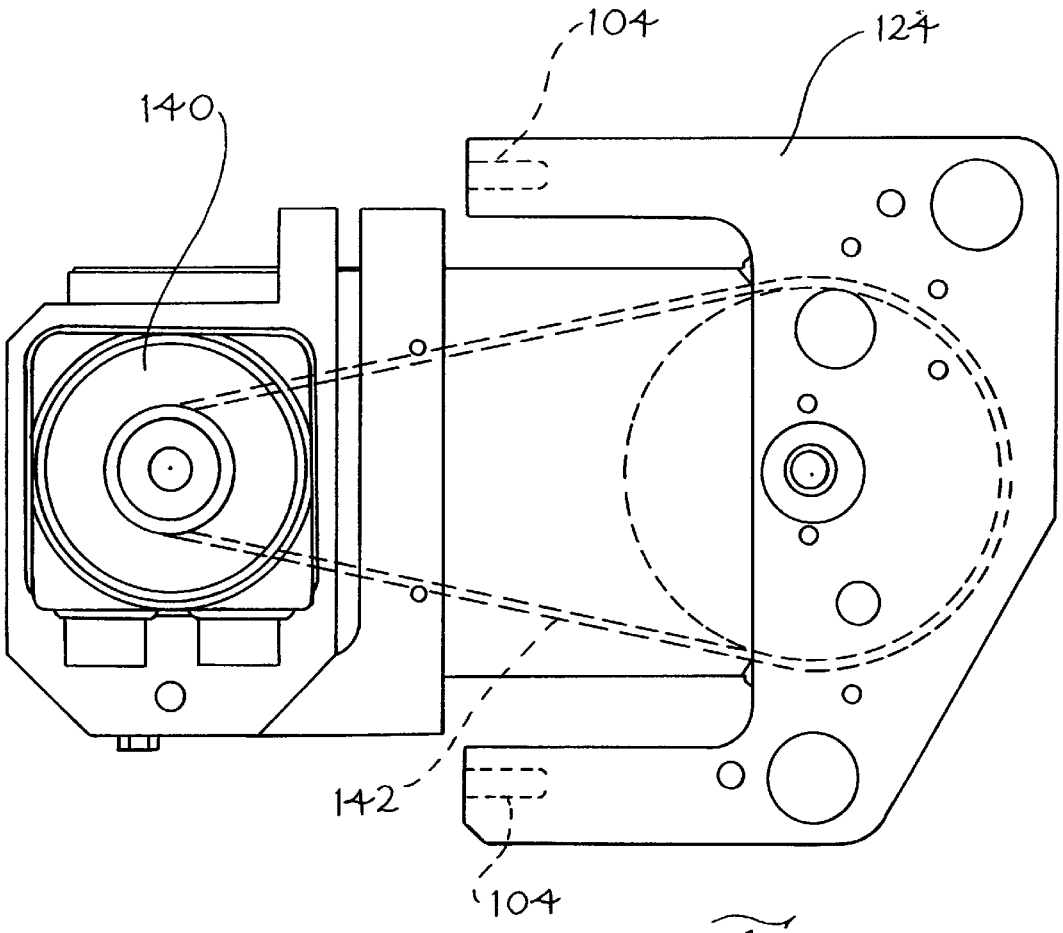
FIG. 11 is a side view of the rotor motor drive from the inside of the rotor carriage.
Figure 13:
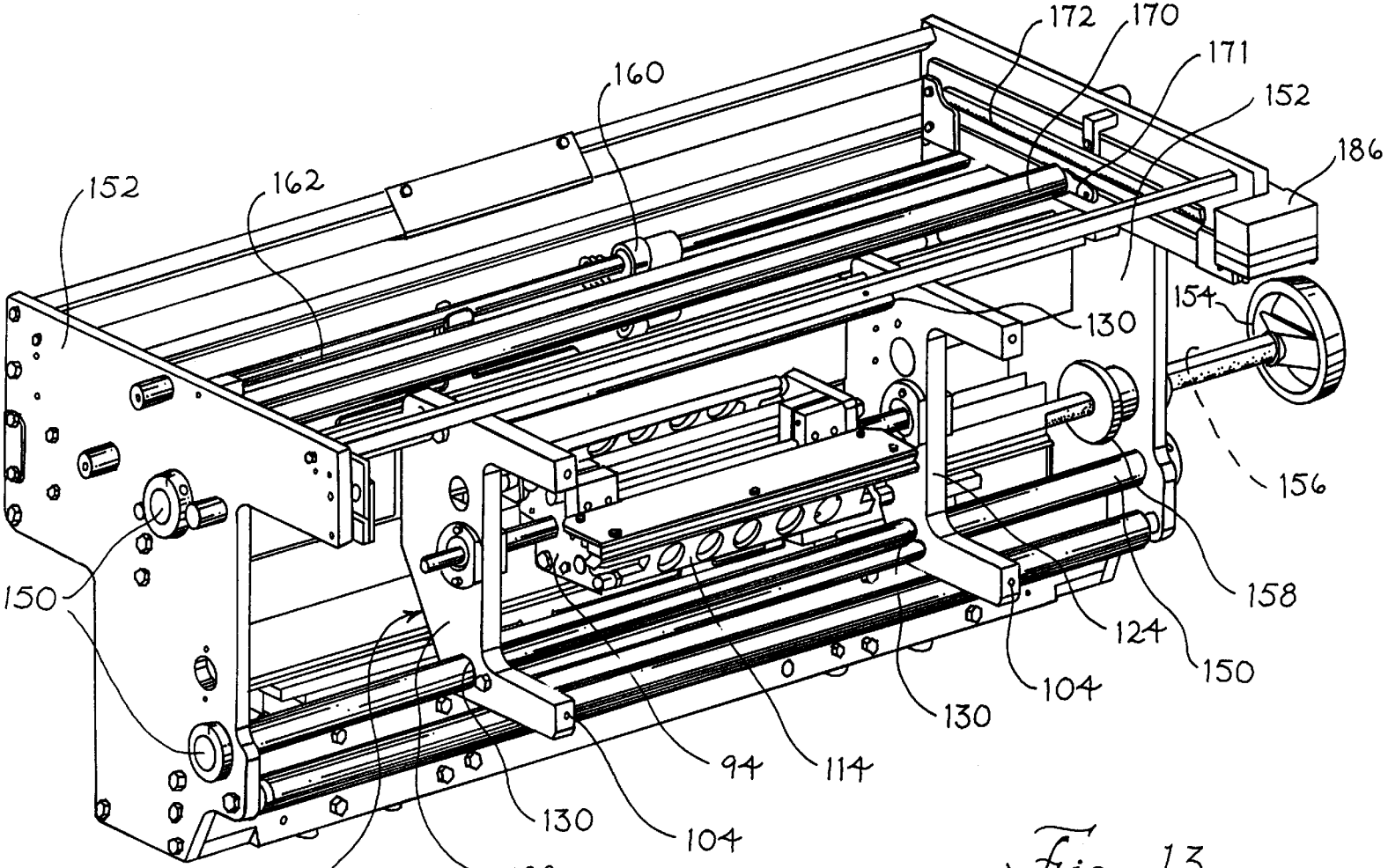
FIG. 13 is a perspective view, from the upper rear, of the zip lock mechanism placement assembly.

It should be noted at this point that the apertures 102 formed in mounting plate 100, as shown in FIG. 2, will receive machine screws that are threaded into threaded holes 104 best seen in FIGS. 7,11 and 13. Through this connection the rotor carriage 120 and all components carried on mounting plate 100 are connected and move laterally as a unit.

Figure 3:
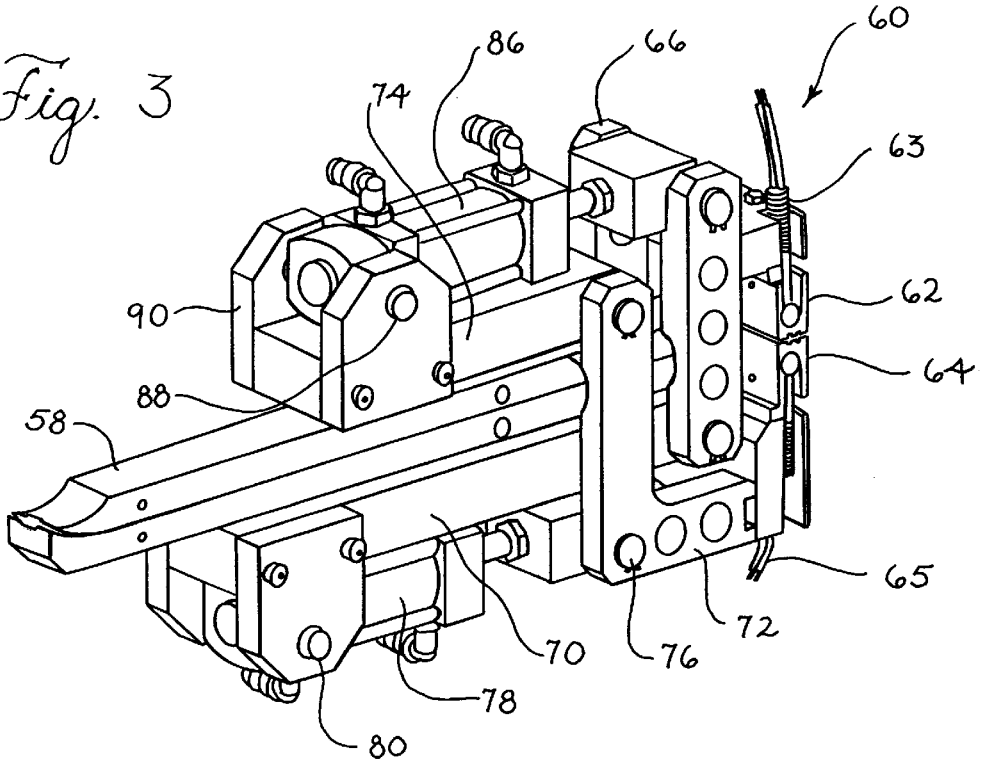
FIG. 3 is a perspective view of the cutter-fuser mechanism.
Figure 4:
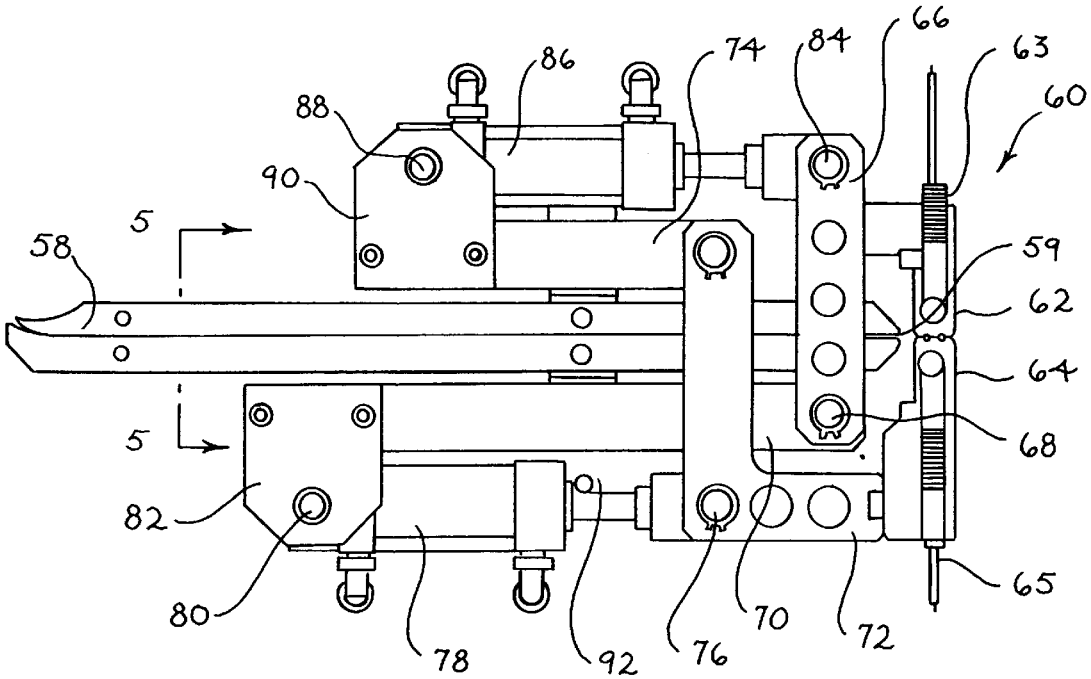
FIG. 4 is a side view of the cutter-fuser mechanism.

The zip-lock cutter-fuser 60 is best shown in FIGS. 3 and 4. The horizontally oriented track 58 extends through the center of the reclosable fastener cutter-fuser 60, in FIGS. 3 and 4. The reclosable fastener material exits the horizontally oriented track 58 through its end 59. The end 59 is located at the juncture of the upper 62 and lower 64 cutter-fuser jaws. As the reclosable fastener material 22 is fed out the end 59 of the track 58 the reclosable fastener jaws are open so that appropriate length of reclosable fastener material 22 can be metered through the open jaws 62, 64. This step of feeding the reclosable fastener material to the outer edge of the rotor locates the reclosable fastener material at its final destination relative to the rotor. No further adjustment of the reclosable fastener material on the rotor is required or made. The jaws 62, 64 include electric heating elements 63, 65 respectively that when energized cause the engaged jaws to both sever and fuse the cut ends of the reclosable fastener strip.

Figure 4A:
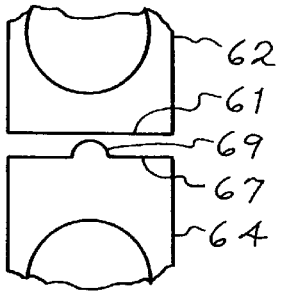
FIG. 4A is an enlarged side view of the severing and fusing jaws.

The preferred embodiment of the severing and fusing surfaces for jaws 62 and 64 is illustrated in FIG. 4A which is an enlarged view. In FIG. 4A upper jaw 62 has a flat severing and fusing surface 61 and the bottom jaw 64 has a severing and fusing surface 67 including a raised ridge 69 having a smooth edge that is oriented such that it is transverse to the longitudinal extent of the reclosable fastener strip. The flat surfaces of the upper 61 and lower 67 severing and fusing surfaces are spaced from each other, about 0.0020 of an inch when severing occurs. The raised ridge 69 approaches the upper flat severing and fusing surface 61 when the jaws 62 and 64 close which severs the reclosable fastener material 22. The severed ends of the reclosable fastener strip are located in the gaps between the upper 61 and lower 67 severing and fusing surfaces where they are positively fused together. Fusing the ends of the strip of reclosable fastener insures that the two halves of the reclosable fastener strip will remain interlocked during the package forming process and will not shift relative to each other. The upper jaw 62 is fixed to a pair of links 66, the lower ends of which are pivoted at 68 to a bar 70. The upper ends of links 66 are pivotally connected at 84 to the rod end of a double-acting pneumatic cylinder 86. The head end of the double acting pneumatic cylinder 86 is pivoted to a clevis 90 carried by an end of bar 74. When cylinder 86 extends it causes upper jaw 62 to move to the point of contact of jaws 62 and 64 at which it severs the reclosable fastener material and fuses the severed ends of the two halves of the reclosable fastener strip to each other. When cylinder 86 retracts it causes upper jaw 62 to move up and back away from the point of contact of jaws 62 and 64.

The lower jaw 64 is fixed to one pair of the free ends of a pair of L-shaped levers 72. The other free ends of L-shaped levers 72 are pivoted to a bar 74. The juncture of L-shaped levers 72 is pivotally connected at 76 to the rod end of a double acting pneumatic cylinder 78 which is pivoted at 80 to a clevis 82 carried by bar 70. When cylinder 78 extends, which is at the same time that cylinder 86 extends, it causes lower jaw 62 to move to the point of contact of jaws 62 and 64 at which it severs the reclosable fastener material and fuses the severed ends of the two halves of the reclosable fastener strip to each other. When cylinder 78 retracts, which is at the same time that cylinder 86 retracts, it causes lower jaw 64 to move down and back away from the point of contact of jaws 62 and 64.

As best seen in FIG. 4, a vertically extending bar 92 that is secured to bars 70 and 74 as well as the horizontally oriented track 58 functions to fix these elements to mounting plate 100 at locations spaced therefrom.

The reason for this elaborate design for opening and closing jaw 62 and 64 is twofold. When pneumatic cylinder 86 is contracted, the upper jaw 62 is moved in an arc shaped path up and back toward the cylinder 86. Also, when the pneumatic cylinder 78 is contracted the lower jaw 64 moves in an arc shaped path down and back toward the cylinder 78. These movement paths accomplish two things. First, it is a more effective way of separating the jaws 62 and 64 from the reclosable fastener strip 22 then if they moved vertically up and down since the arc paths peel the jaws 62, 64 off of the fused reclosable fastener strip. Second, it moves the jaws 62 and 64 away from the severed end of the reclosable fastener strip to permit the severed piece of reclosable fastener strip to be rotated. As shall be discussed further below it is necessary that the jaws 62, 64 open to a position at which they will not interfere with the end of the section of reclosable fastener strip that has just been severed and fussed because the reclosable fastener strip will be rotated 180 degrees.

Figure 6:
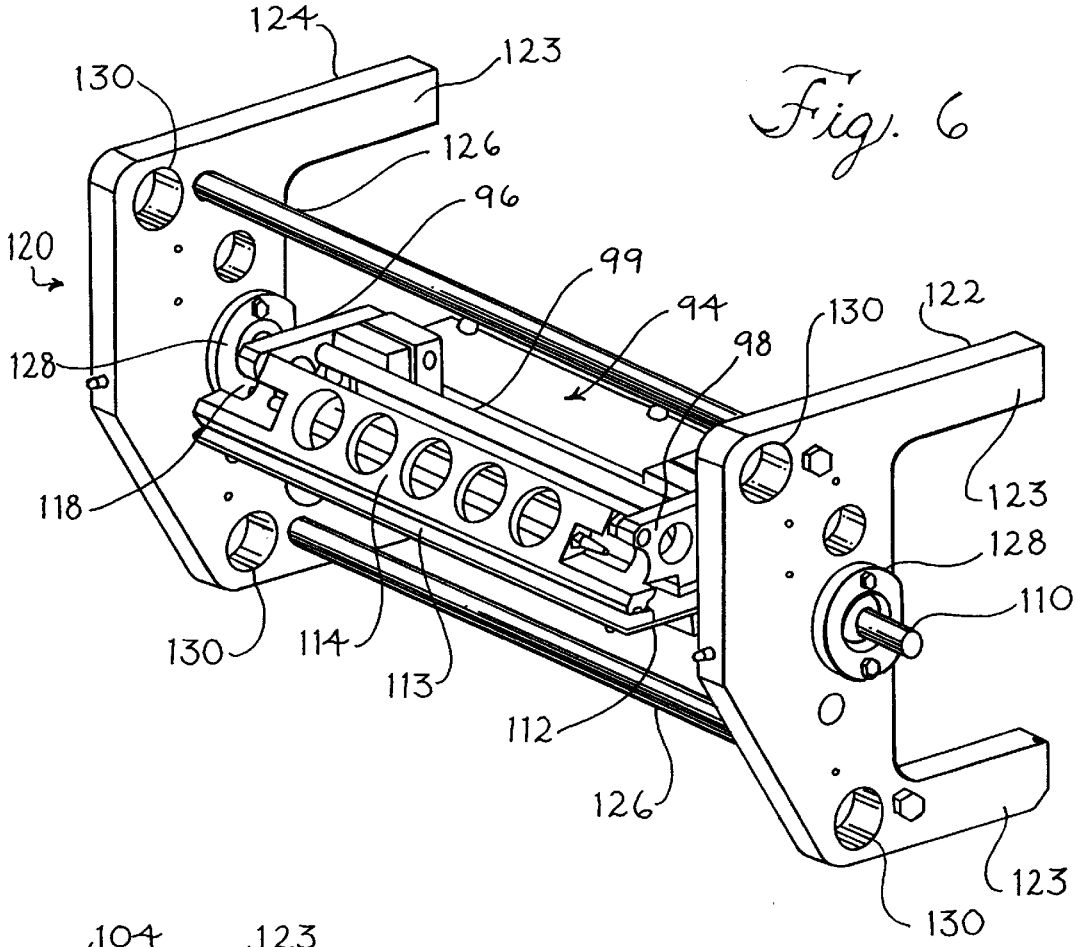
FIG. 6 is a perspective view of the rotor and rotor carriage mechanism.

Referring now to FIGS. 6 and 7, a rotor 94 is located relative to the zip-lock cutter-fuser mechanism 60 such that it receives the major portion of the reclosable fastener material 22 that is metered through the end 59 of the horizontally oriented track 58. The metered section of reclosable fastener material 22 is then held on the rotor 94 while the cutter-fuser mechanism 60 is actuated. The rotor 94 includes a pair of end plates 96 and 98 connected by a reinforcing rod 99. A rotor shaft 110 is fixed to end plates 96 and 98 and extends outwardly therefrom. The two halves of the rotor 94 are substantially symmetrical about its rotor axis which is defined by shaft 110. Referring to the left half as seen in FIG. 6, a flat plate 112, having an outer edge 113, is secured at its ends to end plates 96, 98. As shown in FIG. 7, a resilient holding mechanism 114 that can be spring biased has a track 116 formed along its edge that engages flat plate 112. The resilient holding mechanism 114 is pivotally mounted at 118 to the end plates 96, 98. In FIG. 7 the resilient holding mechanism 114 is spring biased into engagement with the bottom surface of flat plate 112. The outer edge 113 of flat plate 112, in FIG. 7, is spaced away from the film course, since this is the location where the reclosable fastener material 22 is received by the rotor.

The end of reclosable fastener material is fed from the end 59 of horizontally oriented track 58 into the track 116 formed in resilient holding mechanism 114 and biased into engagement with the bottom surface of flat plate 112. The track 116 extends the entire length of the resilient holding mechanism 114. The interlocked portion of the reclosable fastener material 22 lies in the track 116 and the flanges 24 and 26 of the reclosable fastener material 22 extend under the portions of the spring biased hold down device that bears against flat plate 112. The side of the reclosable fastener material 22 having only flange 24 (see FIG. 5) is located along the outer edge 113 of flat plate 112 and extends beyond the outer edge 113.

Immediately following, the reclosable fastener material 22 being positioned in track 116 of the rotor 94 and being severed by the cutter-fuser mechanism 60, a vacuum brake 93 is activated as shown in FIG. 2. Vacuum brake 93 clamps the exposed flange 24 of the reclosable fastener strip 22 so that when the jaws 62 and 64 retract there is no undesirable effect on the reclosable fastener strip, such as pulling it back. Jaws 62 and 64 are heated and it is thus possible that some sticking of the reclosable fastener strip to the jaws 62 and 64 could occur. Thus, while the jaws 62, 64 retract the vacuum brake 93 holds the severed strip of reclosable fastener material in place. Just prior to rotation of the rotor 94 the vacuum brake 93 is released so that the rotor 94 can rotate and carry the severed strip of reclosable fastener material with it.

Figure 8A:
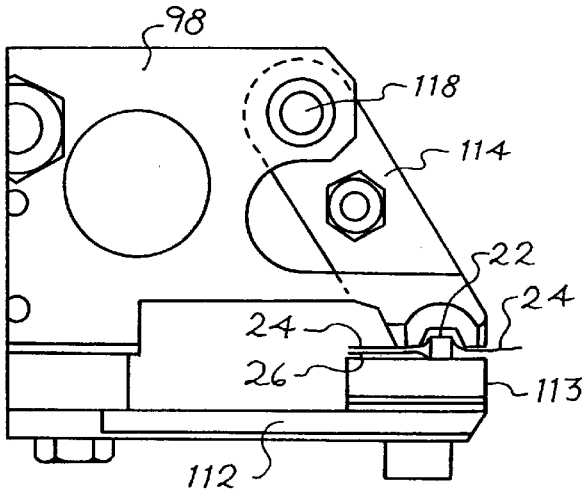
FIG. 8A is an enlarged view showing a reclosable fastener material strip held by the spring biased hold down device.
Figure 8:
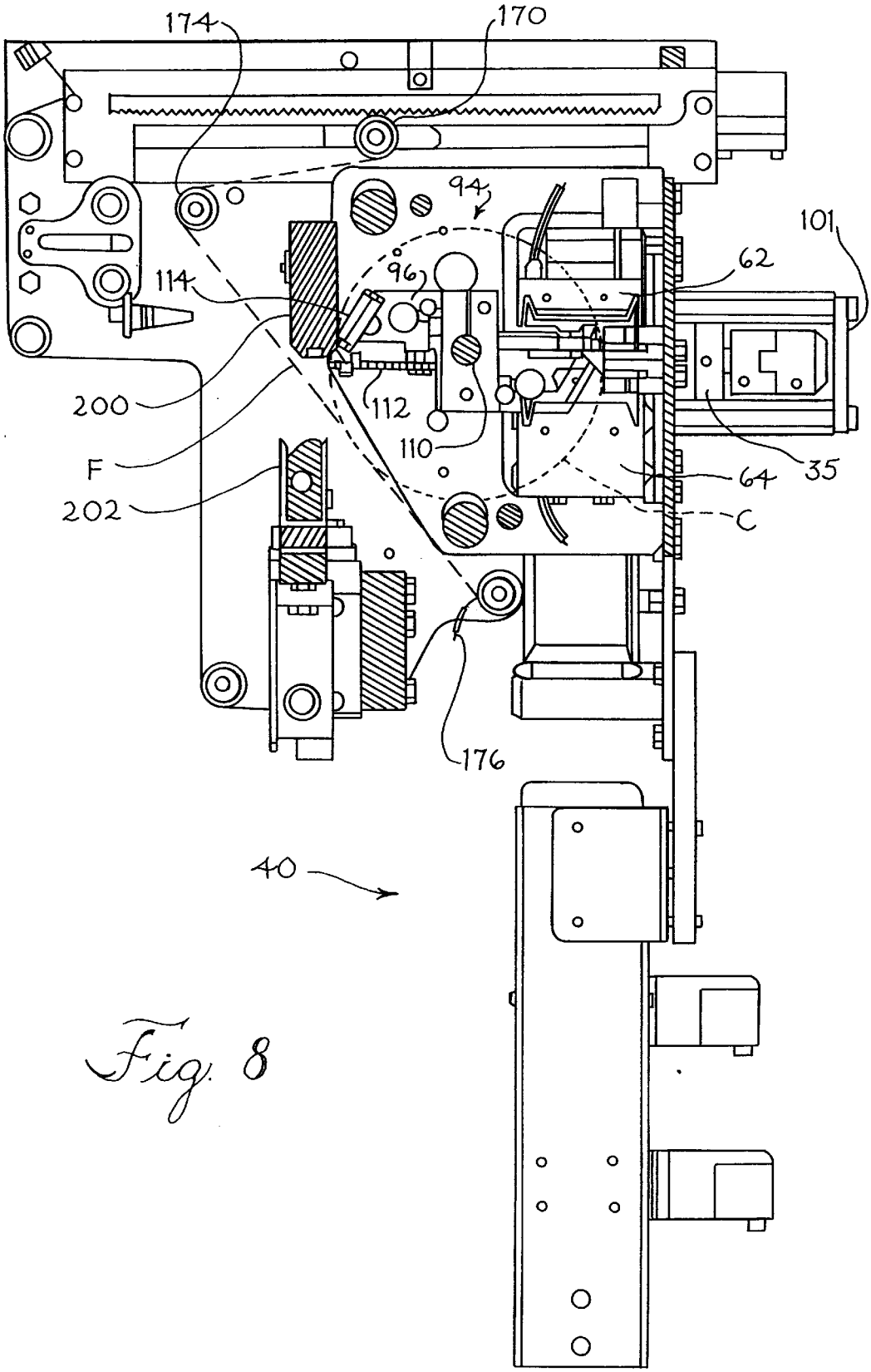
FIG. 8 is a cross section side view of the zipper sealer machine.

After the section of reclosable fastener material that has been received by the rotor 94 has been severed, the rotor is rotated 180 degrees which results in the symmetrical sides reversing positions. After the rotation the left side of the rotor 94, seen in FIG. 7, is now shown in FIG. 6 with the resilient holding mechanism 114 biased into engagement with the upper surface of flat plate 112. Although not shown in FIG. 6, flange 24 of the reclosable fastener strip protrudes beyond the outer edge 113 of flat plate 112 In FIG. 6, the outer edge 113 is located at a position adjacent to the film course. The severed strip of reclosable fastener material is now at the location at which it will be bonded to the film. This relationship is shown in FIG. 8, in which the course of the film F is seen extending diagonally from roll 174 to roll 176. The diagonal film course passes through the vertical center line extending through an upper bonding member 200 and a lower movable bonding member 202. Also, seen in this view is the rotor 94 that rotates about its rotor shaft 110. The circle designated C, in FIG. 8, represents the path that the outer edges 113 of flat plate 112 define as the rotor 94 rotates. After being rotated 180 degrees, to the position seen in FIG. 8, the reclosable fastener strip 22 (not shown) is now resting on the upper surface of a flat plate 112, and would be urged downwardly by resilient holding mechanism 114. FIG. 8A is an enlarged view of the flat plate 112 showing the reclosable fastener strip that is being held by the spring biased hold down device 114. This view clearly shows the flange 24 extending beyond the outer edge 113 of the flat plate 112. It should be noted that FIG. 8A is seen from the opposite direction than FIG. 8. At this time in the cycle, the lower bonding member is energized and moves upwardly toward the stationary upper bonding member 200. The lower bonding member 202 encounters the bottom surface of film F as it moves up. As the upward movement continues, the flange 24 of the reclosable fastener strip 22, that is protruding from the outer edge 113 of the flat plate 112 is grasped and held stationary against the upper surface of the film F and the upper bonding member 200. The lower bonding member 202 is biased upwardly resulting in the reclosable strip material being held stationary between the upper and lower bonding members 200, 202. The bonding members 200 and 202 then carry out their function to bond the flange 24 of the reclosable fastener strip 22 to the upper surface of the film F. When holding the flange 24 stationary the under lying film is also held. The rotor 94 is then rotated another 6 degrees which causes the reclosable member 22 to pop out from under the resilient holding mechanism 114.

Referring now to FIGS. 6 and 7, the rotor carriage 120 includes a pair of end plates 122 and 124 that are joined by a pair of spacer bars 126. Each end plate 122 and 124 has an upper and a lower finger like projection 123 and a bushing 128 that receives the rotor shaft 110 of rotor 94. Each end plate 122 and 124 has two apertures formed therein into which are inserted anti friction slide devices 130. As best seen in FIG. 7, tapped holes 104 are formed in the ends of each of the finger like projections 123. The rotor carriage 120 is secured to mounting plate 100 by screws or the like, that extend through aligned holes 102 and 104.

Figure 9:
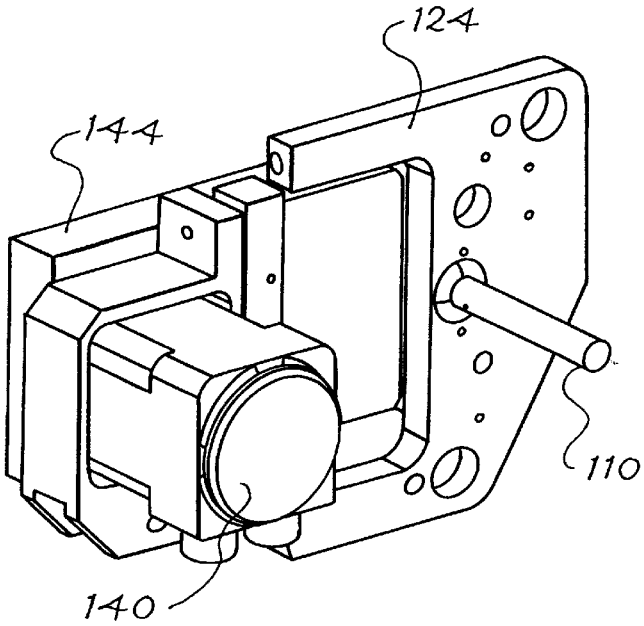
FIG. 9 is a perspective view of the rotor motor drive from the outside of the rotor carriage.
Figure 10:
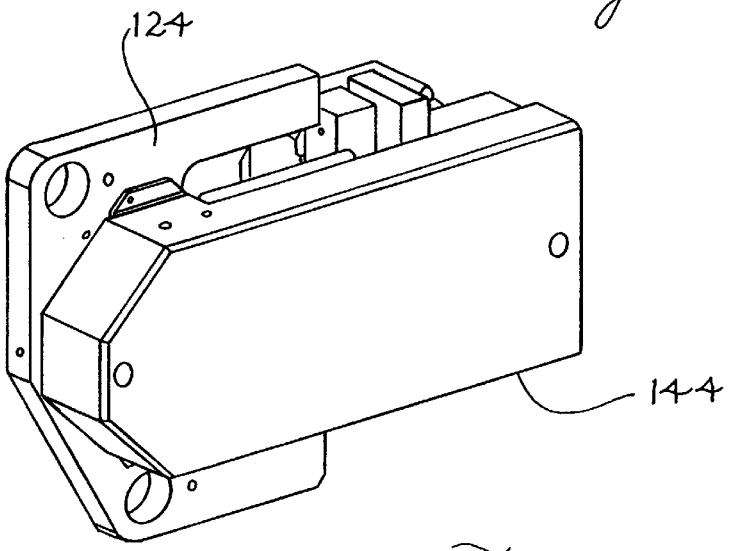
FIG. 10 is a perspective view of the rotor motor drive from the inside of the rotor carriage.

As seen in FIGS. 9–11 a servo motor 140 is secured to the outer surface of end plate 124 and is connected by a belt 142 or the like to the rotor shaft 110 of the rotor 94. The belt drive 142 is covered by a housing 144. Servo motor 140 is energized to rotate the rotor 94, 180 degrees, for each cycle after receiving a strip of severed reclosable fastener material 22 and then the additional 6 degree to strip the reclosable fastener strip 22 from the grasp of the resilient holding mechanism 114.

Figure 14:
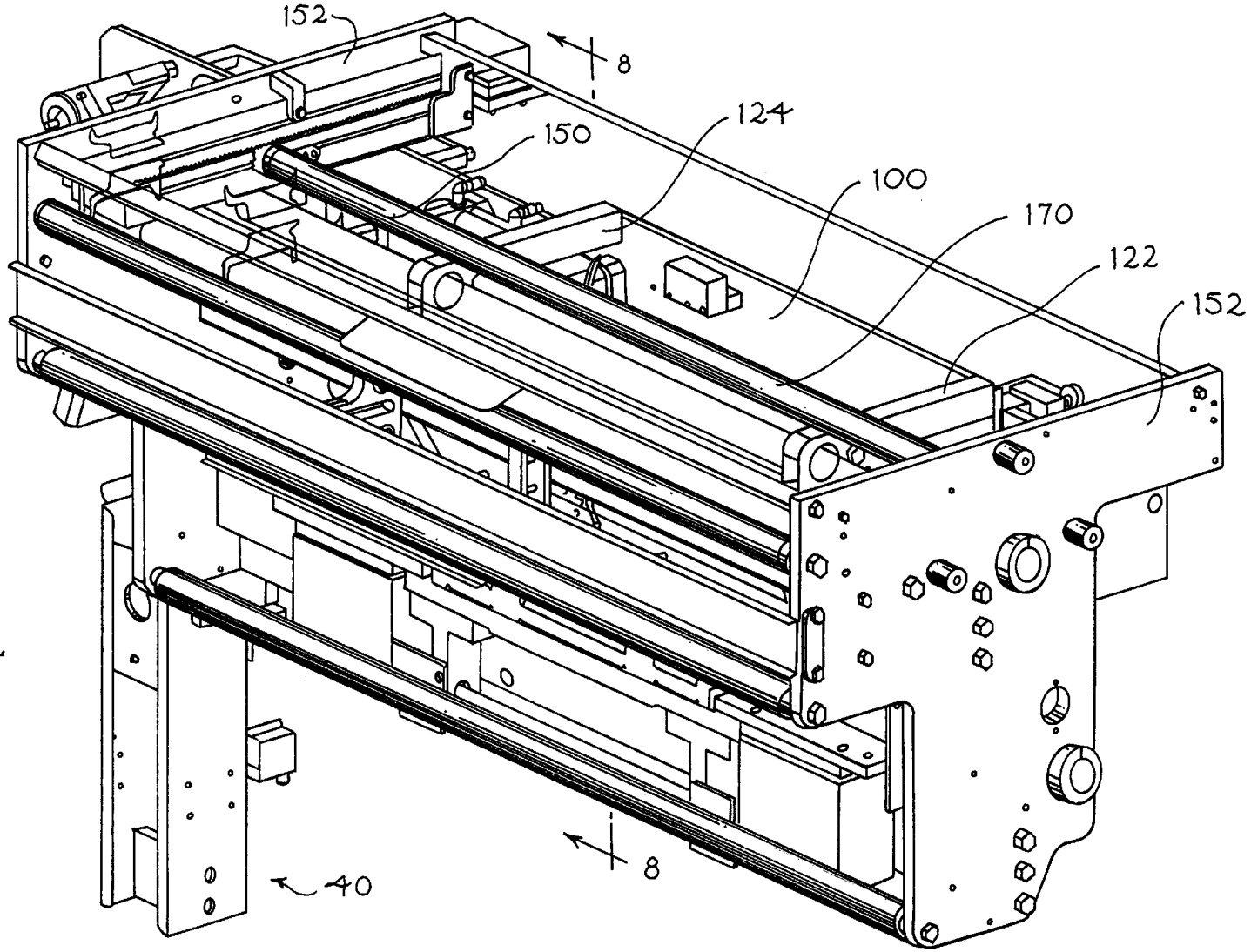
FIG. 14 is a perspective view of the zipper sealer machine.

As seen in FIG. 13 the rotor 94 is pivotally mounted on the rotor carriage 120 on the rotor shaft 110. The rotor carriage 120 is carried by a pair of slide bars 150 that extend through apertures formed in end plates 122 and 124 that have been provided with anti friction slide devices 130. The slide bars 150 are secured at their ends to a pair of T-shaped end plates 152. The T-shaped end plates 152, as best seen in FIGS. 1 and 14, are carried by horizontal members 13 of the main machine frame. As a result of the slide bars 150 and the anti friction slide devices 130 the rotor carriage 120 is free to slide from between the T-shaped end plates 152. As earlier discussed, the mounting plate 100 is secured to the rotor carriage 120 through the tapped holes 104 and thus the entire zipper sealer machine slides with the rotor carriage 120 between T-shaped end plates 152. This ability to slide laterally of the direction of film feed enables the reclosable fastener strip to be secured to the film at various laterally spaced positions on the film. Handle 154, that is secured to the free end of rod 156 functions to adjust the lateral location of the rotor carriage 120 between the end plates 152. The rod 156 has external threads formed thereon and extends through a knob 158 that is carried by end plate 152. The knob 158 has internal threads that mesh with the external threads of rod 156. The end of rod 156, opposite handle 154, is attached to the rotor carriage end plate 124 such that it can rotate relative thereto while transmitting lateral movement in either direction to the rotor carriage 120.

The film used to produce packages on form, fill and seal machines often includes printed fastener material . This printed fastener material , called the printout, must be coordinated with the top and bottom edges and the longitudinal seam of the package. The printout typically includes a unique symbol that can be recognized by an electric eye directed at the film. When the electric eye recognizes the symbol a signal is sent to the central processing unit of the form, fill and seal machine. One of the rollers of the film guide mechanism has an attached encoder that functions to control the length of film that is fed for each package and thus insure, with good precision, the proper location of the reclosable fastener strip. The control system uses this signal to coordinate the position of the printout in respect to the cross sealing jaws, to insure proper alignment of the printout and zipper with the physical properties of the package. In FIG. 13, the slider 160, which is carried by a cross shaft 162, carries the electric eye that scans for the symbol contained in the printout. Electric eye 164 must be properly located along cross shaft 162 so that it will be scanning the longitudinal extending corridor of the film that contains the symbol. Recognition of this marking causes a signal to be sent to the central processing unit of the form, fill and seal machine and is used as the timing base point for positioning the printout.

Figure 12:
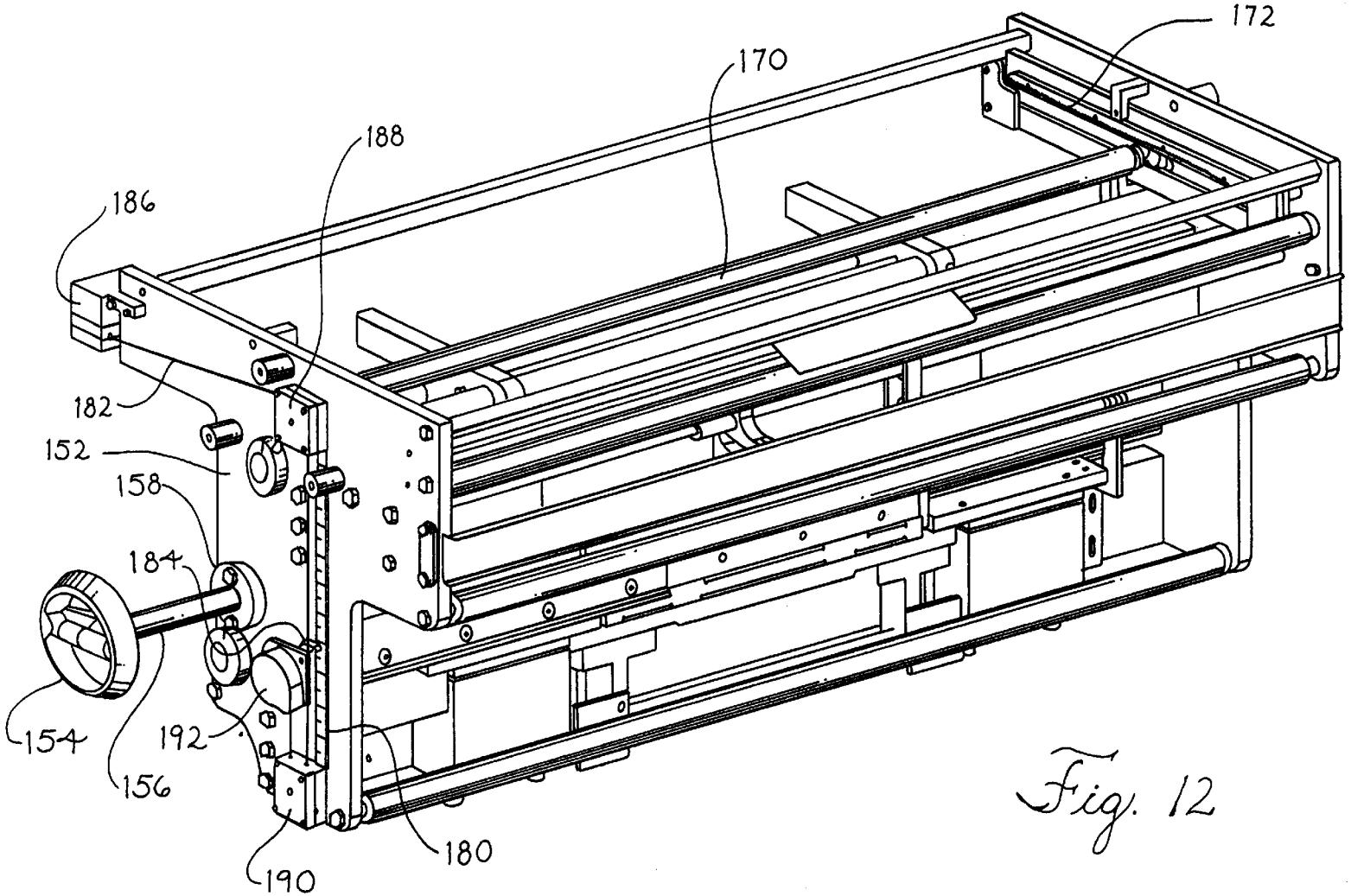
FIG. 12 is a perspective view, from the upper front, of the reclosable fastener material mechanism placement assembly.

The film positioning roll 170, seen in FIGS. 8,12,13 and 14, is a component of the film guide mechanism. As best seen in FIG. 8 the film F extends downwardly from roll 170 to a roll 174 around which it wraps and then to a roll 176 around which it also wraps. Rolls 170,174 and 176 are all components of the film guide mechanism. Roll 170 can be adjusted fore and aft however rolls 174 and 176 are not adjustable. The strip of zip lock fastener material 22 is secured to the strand of film that extends between rolls 174 and 176. Roll 170 is movable fore and aft such that it functions to adjust the longitudinal position on the film to which the reclosable fastener strip is bonded. The portion of the film course, extending between rolls 174 and 176, is not changed as a result of adjusting roll 170. Rather, the film is moved up or down relative to the location on the film so that the upper bonding member 200 and lower bonding member 202 will engage the film when lower bonding member 202 is activated and moves upwardly. Thus, adjustment of roll 170 allows the machine operator to fine tune the position at which the severed reclosable fastener material will be bonded to the film, relative to the printout. Most film that is used to produce packages has printed fastener material on it and it is important that the top and bottom of the package is properly oriented with respect to this printout. If roll 170 is moved forward or backward along tracks 172, fine-tune the position at which the reclosable fastener strip will be secured, relative to the printout, is adjusted. As seen in FIG. 12, a scale 180 is provided on the outer face of T-shaped end plate 152. The roll 170 has an arm 171, see FIG. 13, to which a line or cord 182 is attached. The line 182 extends from arm 172 to a member 186. The line or cord 182 can be seen in FIG. 12 coming out of member 186, extending generally horizontally through member 188 and turning downwardly. The line then enters member 190 from which it turns up and extends into winder 192. Members 186,188 and 190 each include anti-friction devices such as rollers over which the line 182 extends so the line can change direction with minimum friction. Winder 192 is spring loaded and maintains the line 182 taut. The line or cord 182 has a pointer 184 secured thereto at a location such that the pointer moves over the scale 180 as roll 170 is adjusted within its range. The position of pointer 184 relative to the scale 180 indicates the exact location of film positioning roller 170. The elements 180–192 thus function as a take up mechanism.

The film path from the point where the bonding members 200 and 202 bond the reclosable fastener material strip to the film to the point where the cross sealing jaws produce the cross seal must be of a length that when divided by the bag length equals an integer. The take up mechanism 180–192 permits length to be added to or subtracted from an existing film path length to attain the necessary length. This adjustment is made in one direction when the form, fill and seal machine is making bags from clear film and from the opposite direction when bags having printing on the film are being produced.

When producing bags from film that has printing thereon, it is conventional to include in the printing indicia know in the industry as the "eye-spot". An electric eye is aimed at the longitudinal line along the film where the eye-spot is located. When the electric eye recognizes an eye spot a signal is sent to the central processing unit 300 that controls the form, fill and seal machine. The central processing unit 300 uses this signal to determine when the film feed must be stopped to enable the cross feed jaws to be closed. As a result the cross seal of the bag is properly oriented with respect to the printing thereon. Thus, when running printed bags the location at which the cross seal is applied is considered the fixed position and adjustment is made through the take up mechanism 180–192 to bond the reclosable fastener material strip at a location along the film path that is an integer times the bag length from this fixed position. The take up mechanism 180–192, that causes the film to move between guide rollers 174 and 176, is manipulated until the reclosable fastener material strip is bonded at the desired location. In other words it is as though the cross seal jaws were closed on the film at the proper position relative to the printing on the film and adjustment is made through the take up mechanism 180–192, causing the film to move between guide rollers 174 and 176, until the exact film position under the seal bar 200 is attained.

For clear film the adjustment is attained by working in the other direction. This is accomplished by keying in on the system control side for example a bag length of 10.25 inches. You then run enough bags until a bag shows up at the cross jaws. This bag is inspected to determine where the cross seal is relative to where it ideally should be. Adjustments are then made through the take up mechanism 180–192 until bags with the cross seal properly located are produced.

Figure 15:
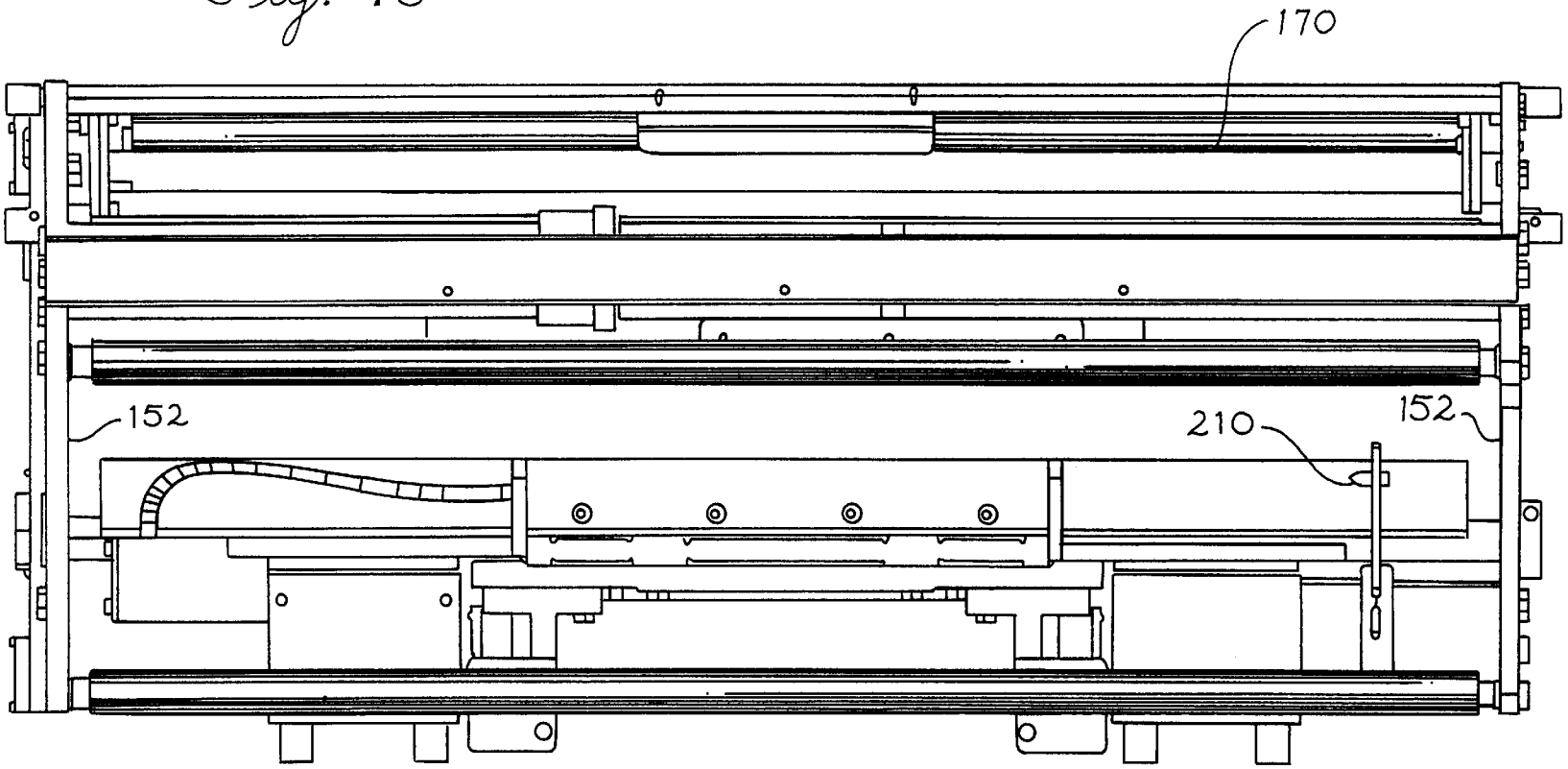
FIG. 15 is a front view of the zipper sealer machine.

The sealer or bonding mechanism for applying the reclosable fastener strip to the surface of the film before that section of the film reaches the forming shoulder 16 must be timed with the cross jaws of the form, fill and seal machine 10 since both of these operations are performed while the film is at rest. A sealer detector proximity switch 210, as shown in FIG. 15, is provided to recognize the sealer, or bonding mechanism, in its sealing position. The reclosable fastener strip is being sealed to the film surface when the sealer is at this position. Proximity switch 210 sends signal when the bonding procedure is initiated and when it is finished. When the signal from proximity switch 210 is received by the central processing unit 300, the time for actuating the rotor is determined, to assure release of the reclosable fastener strip from the rotor.

A dry air film and seal cooling device is provided that blast a stream of air on the film when the film is advancing toward the forming shoulder 16 with the reclosable fastener strip 22 bonded to it. The purpose of the dry air is to cool the reclosable fastener strip and film so that when it goes over the next roller the reclosable fastener strip will not be separated.

Figure 16:
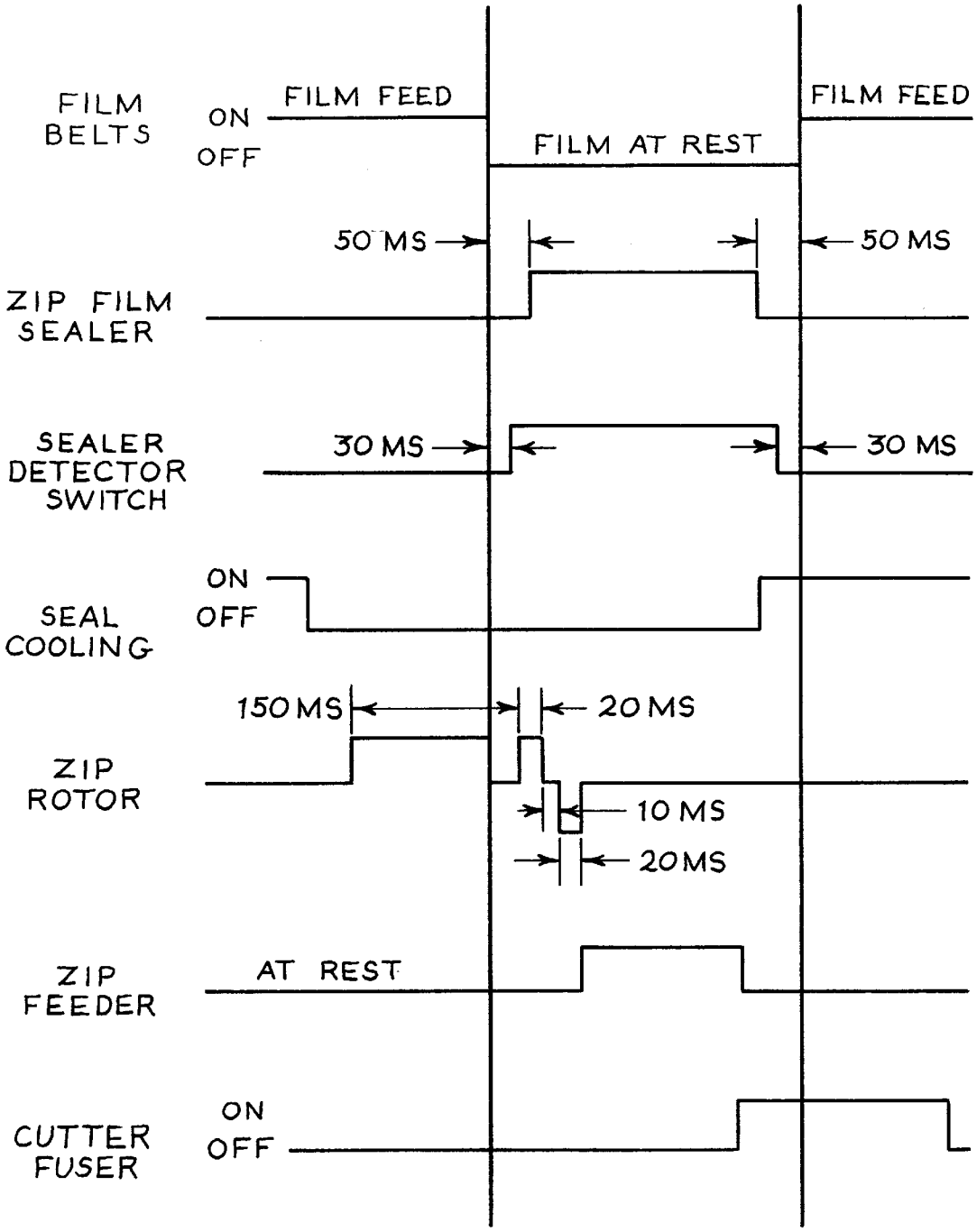
FIG. 16 is a timing diagram for the zipper sealer machine components.

FIG. 16 is a timing diagram that illustrates the timing relationships of the various components that cooperate to prepare the strip of reclosable fastener material 22 and seal it to the inside surface of the film. The timing diagram illustrated in FIG. 16 is for a package forming system in which the film is being fed for about 60% of the cycle and is stationary for about 40% of the cycle. While the film is stationary, the reclosable fastener strip 22 is sealed to the upper surface of the film before the film reaches the forming shoulder 16. At the same time, the cross-sealing jaws are energized to close the top of a package that has just been completed and seal two flanges of the zipper to the film. In some embodiments, the cross-sealing operation also creates a perforation between the seals. This cross-sealing operation creates the bottom seal for the next package to be filled and sealed.

The first component in the timing chart is the film belts which pull the film down the forming tube 18. The film belts are ON while the film is being fed and OFF when the film is at rest. The section of this timing line that is at the OFF level represents the approximately 40% of the package cycle during which the film is stationary. Assuming that the form, fill and seal machine is producing 60 packages per minute, the film would be at rest for approximately 400 milliseconds.

The next component shown in the timing chart is the zip-lock sealer. The zip-lock sealer is activated while the film is stationary but starts slightly after the film comes to rest and is completed slightly before the film begins to feed again. In the timing diagram, both of these short time periods are indicated to be 50 milliseconds, however the period is exemplary only and they could vary from those indicates in this figure.

The next component in the timing chart is the sealer detector proximity switch. This device detects the presence of the reclosable fastener strip in the area of the sealing or bonding mechanism during the sealing process. The sealer detector proximity switch is activated slightly after the film comes to rest and is deactivated slightly before the film begins to feed again. In the timing chart these short periods are shown as being preferably 30 milliseconds, the proximity switch is activated and deactivated while the film is at rest. The timing chart also shows that sealer detector proximity switch is activated just before the sealer is at its sealing position and remains activated for as long as the sealing process is maintained.

The next component is the dry-air seal cooling device. As illustrated by the time line this device is not activated until the sealer is deactivated.

The next component is the rotor. The zip-lock rotor is rotated 180 degrees while the film is being fed, and the rotation is shown to take about 150 milliseconds. At the same time that the sealer is activated, the rotor is rotated another 6 degrees. As previously discussed, this 6 degree rotation causes the section of reclosable fastener strip to be pulled out from under the resilient holding mechanism of the rotor. The zip-lock rotor is then rotated 6 degrees in the reverse direction which prepares the other side of the rotor to be in position to receive the reclosable fastener material.

The next component shown in the timing chart is the reclosable fastener feeder. As best seen by comparing the time lines for this component and the time line for the rotor, the feeding of the reclosable fastener material does not start until the rotor has been rotated 6 degrees in the reverse direction. The time duration for this feeder to be ON depends upon how long or sort the reclosable fastener strip will be.

The next component shown in the timing chart is the reclosable fastener fuser. This component should begin its cutting-fusing process soon after the feeding of the reclosable fastener material has been completed. Since there will be a considerable time delay between when the pneumatic cylinders 78 and 86 are activated and when the jaws 62 and 64 engage the reclosable fastener material, the reclosable fastener fuser is activated while the feeder is still active. This reclosable fastener cutter is timed to engage the reclosable fastener material slightly after it has come to rest. The timing charts indicates that this short time period should be at a maximum 30 milliseconds.

While the invention has heretofore been described in detail with particular reference to illustrated apparatus, it is to be understood that variations, modifications and the use of equivalent mechanisms can be effected without departing from the scope of this invention. It is, therefore, intended that such changes and modifications be covered by the following claims.

It is intended that the accompanying drawing and foregoing detailed description is to be considered in all respects as illustrative and not restrictive, the scope of the invention is intended to embrace any equivalents, alternatives, and/or modifications of elements that fall within the spirit and scope of the invention, and all changes which come within the meaning and range of equivalency of the claims are therefore intended to be embraced therein.

What is claimed is:

1. In a process for forming packages with reclosable fasteners on a form, fill and seal machine including a forming tube and cross sealing jaws, the operation of which is controlled by a central processing unit, comprising the steps of:

providing a film roll from which a continuous web of film is provided to the form, fill and seal machine, from which a package will be formed;

providing a film guide mechanism in the form, fill and seal machine for guiding the film from said film roll in a direction of film feed along a film course to the forming tube of the form fill, and seal machine;

providing a rotor, having substantially symmetrical sides formed about its rotor axis, and each substantially symmetrical side has an outer edge that is substantially parallel to its axis of rotation;

mounting said rotor on said form, fill and seal machine, such that its axis is transverse to the direction of film feed along the film course, each outer edge being movable into a position adjacent to the film course;

providing a continuous supply of reclosable fastener material strip fastener material having a free end;

feeding said free end of the reclosable fastener material to one of said outer edges of the rotor that is spaced from the film course such that a predetermined portion of reclosable fastener material has been fed to the rotor;

retaining the predetermined portion of reclosable fastener material on the outer edge of the rotor that is spaced from the film course;

severing said continuous supply of reclosable fastener material from the predetermined portion retained on the outer edge of the rotor such that a strip of reclosable fastener material having severed ends is retained on the outer edge;

rotating the rotor about its axis in a first direction such that the outer edge along which the strip of reclosable fastener has been retained is moved into the position adjacent to the film course;

bonding the strip of reclosable fastener material that is retained along the outer edge of the rotor adjacent to the film course to the surface of the film.

2. In a process for forming packages with reclosable fasteners, held in a radial track, on a form, fill and seal machine in accordance with the steps of claim 1 said process further comprising:

wherein the strip of reclosable fastener material is retained on the outer edge of the rotor by a resilient holding mechanism.

3. In a process for forming packages with reclosable fasteners on a form, fill and seal machine in accordance with the steps of claim 1 said process further comprising:

wherein said portion of reclosable fastener material that is external of the radial track is has a mounting flange and said strip of reclosable fastener material is retained on said rotor with said mounting flange extending beyond said radial track and the outer edge of the rotor.

4. In a process for forming packages with reclosable fasteners on a form, fill and seal machine in accordance with the steps of claim 2:

wherein the strip of reclosable fastener material that is fed to the rotor has a mounting flange and said strip of reclosable fastener material is retained on said rotor with said mounting flange extending beyond said radial track of the rotor.

5. In a process for forming packages with reclosable fasteners on a form, fill and seal machine in accordance with the steps of claim 3:

wherein the mounting flange of the strip of reclosable fastener material is held stationary against the surface of the film by a bonding mechanism.

6. In a process for forming packages with reclosable fasteners on a form, fill and seal machine in accordance with the steps of claim 4:

wherein the mounting flange of the strip of reclosable fastener material strip fastener material is held stationary against the surface of the film by a bonding mechanism.

7. In a process for forming packages with reclosable fastener material strips on a form, fill and seal machine in accordance with the steps of claim 6:

wherein rotation of the rotor about its axis is resumed, in said first direction, for an angle that will move the outer edge of the rotor along which the strip of reclosable fastener material is retained away from the location at which the flange of the strip of reclosable fastener material is held stationary against the surface of the film by bonding mechanism, such that the strip of reclosable fastener material is released by the resilient holding mechanism.

8. In a process for forming packages with reclosable fasteners on a form, fill and seal machine in accordance with the steps of claim 1 said process further comprising:

wherein the bonding of the strip of reclosable fastener material to the surface of the film is sensed by a sealer detector;

sending a signal from the sealer detector to the central processing unit of the form, fill and seal machine to record when the bonding occurred; and coordinating the operation of said cross sealing jaws with the signal indicating when the bonding occurred.

9. In a process for forming packages with reclosable fasteners on a form, fill and seal machine in accordance with the steps of claim 2:

wherein the bonding of the strip of reclosable fastener material to the surface of the film is sensed by a sealer detector;

sending a signal from the sealer detector to the central processing unit of the form, fill and seal machine to record when the bonding occurred; and coordinating the operation of said cross sealing jaws with the signal indicating when the bonding occurred.

10. In a process for forming packages with reclosable fasteners on a form, fill and seal machine in accordance with the steps of claim 3:

wherein the bonding of the strip of reclosable fastener material to the surface of the film is sensed by a sealer detector;

sending a signal from the sealer detector to the central processing unit of the form, fill and seal machine to record when the bonding occurred; and coordinating the operation of said cross sealing jaws with the signal indicating when the bonding occurred.

11. In a process for forming packages with reclosable fasteners on a form, fill and seal machine the operation of which is controlled by a central processing unit as recited in claim 1, wherein the improvement comprisis:

when performing the step of feeding the reclosable fastener material to the radial track of the rotor it is fed to a final destination relative to the rotor.

12. In a process for forming packages with reclosable fasteners on a form, fill and seal machine the operation of which is controlled by a central processing unit as recited in claim 1, wherein the improvement comprises:

simultaneously with performing the step of severing said continuous supply of reclosable fastener material the severed ends of said reclosable fastener material are fused.

* * * * *

UNITED STATES PATENT AND TRADEMARK OFFICE

CERTIFICATE OF CORRECTION

PATENT NO. : 6,012,264

DATED : January 11, 2000

INVENTOR(S) : John M. Linkiewicz

It is certified that error appears in the above-identified patent and that said Letters Patent is hereby corrected as shown below:

Title page, [54] Title, change "ZIPPER SEALER MACHINE" to -- PROCESS FOR BONDING A ZIPPER SEAL TO A PACKAGE IN A FORM, FILL, SEAL MACHINE --

In the Abstract, [57], line 3, delete "strip fastener material".

In the Abstract, [57], line 10, delete "strip fastener material".

In the Abstract, [57], line 12, change "reclosable fastener material strip fastener material ." to -- reclosable fastener material--

In the Abstract, [57], line 13, delete "strip fastener material".

In the Abstract, [57], line 16, delete "strip fastener material".

In the Abstract, [57], line 21, delete "material".

Claim 1, Col. 12, line 14, delete "strip fastener material".

Claim 1, Col. 12, line 29, after "fastener" insert -- material --.

Claim 4, Col. 12, line 53, after "claim 2" insert -- said process further comprising --.

Claim 5, Col. 12, line 61, after "claim 3" insert -- said process further comprising --.

UNITED STATES PATENT AND TRADEMARK OFFICE

CERTIFICATE OF CORRECTION

PATENT NO. : 6,012,264

DATED : January 11, 2000

INVENTOR(S) : John M. Linkiewicz

It is certified that error appears in the above-identified patent and that said Letters Patent is hereby corrected as shown below:

Claim 6, Col. 12, line 67, after "claim 4" insert -- said process further comprising --;

Col. 13, line 2, delete "strip fastener material".

Claim 7, Col. 13, line 6, after "reclosable" delete "fastener material strips" and insert therefor -- fasteners --.

Claim 7, Col. 13, line 7, after "claim 6" insert -- said process further comprising --.

Claim 9, Col. 13, line 31, after "claim 2" insert -- said process further comprising --.

Claim 10, Col. 14, line 8, after "claim 3" insert -- said process further comprising --.

Claim 11, Col. 14, lines 19-20, delete "as recited in claim 1, wherein the improvement comprisis" to -- in accordance with the steps of claim 1, said process further comprising --.

Signed and Sealed this

Fifth Day of December, 2000

*Attest:*

*Attesting Officer*

Q. TODD DICKINSON

*Director of Patents and Trademarks*